US012371865B2

(12) United States Patent
Song et al.

(10) Patent No.: US 12,371,865 B2
(45) Date of Patent: Jul. 29, 2025

(54) SNOW SHOVELING AND SNOW DISCHARGING ASSEMBLY OF SNOW SWEEPING ROBOT

(71) Applicants: Chongqing University, Chongqing (CN); Star Institute of Intelligent Systems, Chongqing (CN); Dibi (Chongqing) Intelligent Technology Research Institute Co., Ltd., Chongqing (CN)

(72) Inventors: Yongduan Song, Chongqing (CN); Hong Long, Chongqing (CN); Junfeng Lai, Chongqing (CN); Fang Hu, Chongqing (CN); Ke'er Chen, Chongqing (CN)

(73) Assignees: Chongqing University, Chongqing (CN); Star Institute of Intelligent Systems, Chongqing (CN); Dibi (Chongqing) Intelligent Technology Research Institute Co., Ltd., Chongqing (CN)

( * ) Notice: Subject to any disclaimer, the term of this patent is extended or adjusted under 35 U.S.C. 154(b) by 1025 days.

(21) Appl. No.: 17/397,459

(22) Filed: Aug. 9, 2021

(65) Prior Publication Data

US 2022/0403612 A1 Dec. 22, 2022

(30) Foreign Application Priority Data

Jun. 18, 2021 (CN) ..... 202110677370.9

(51) Int. Cl.
*E01H 5/00* (2006.01)
*E01H 5/09* (2006.01)

(52) U.S. Cl.
CPC ..... *E01H 5/098* (2013.01)

(58) Field of Classification Search
CPC ..... E01H 5/098
See application file for complete search history.

(56) References Cited

U.S. PATENT DOCUMENTS 3,075,813 A * 1/1963 Vohl ..... E01H 5/045 406/165
10,041,588 B2 * 8/2018 Yuki ..... B60W 30/1884
10,767,327 B2 * 9/2020 Champagne ..... F16H 7/1209
11,753,785 B2 * 9/2023 Yamazaki ..... E01H 5/09 37/252
11,846,078 B2 * 12/2023 Johnson ..... E01H 5/09
12,006,645 B2 * 6/2024 Zha ..... E01H 5/098
(Continued)

*Primary Examiner* — Claude J Brown
(74) *Attorney, Agent, or Firm* — Tutunjian & Bitetto, P.C.

(57) ABSTRACT

Disclosed is a snow shoveling and snow discharging assembly of a snow sweeping robot. The snow shoveling and snow discharging assembly comprises a snow stirring structure, a snow feeding structure and a snow raising structure. Stirring cutters in the snow stirring mechanism are driven by a stirring cutter shaft to stir bottom area snow into a snow feeding pipe of the snow feeding structure, an air blower in the snow feeding structure blows accumulated snow into a snow raising pipe of the snow raising structure through a connecting pipe, the snow raising pipe can be driven by a steering motor to rotate by a certain angle to control the snow raising direction, and a second electric push rod acts to control pitching of the guide part, so that the height of snow during snow raising is controlled.

11 Claims, 5 Drawing Sheets

(56) References Cited

U.S. PATENT DOCUMENTS

| | | | | |
|---|---|---|---|---|
| 2001/0008055 | A1* | 7/2001 | Sueshige | F16D 3/68 37/249 |
| 2015/0068074 | A1* | 3/2015 | Mast | E01H 5/098 37/197 |
| 2021/0064045 | A1* | 3/2021 | Yamamura | G05D 1/0044 |
| 2022/0389674 | A1* | 12/2022 | Plumer | E01H 5/061 |
| 2023/0228051 | A1* | 7/2023 | Mandeville | E01H 5/08 37/261 |
| 2023/0418301 | A1* | 12/2023 | Yamamura | G05D 1/0234 |

* cited by examiner

SNOW SHOVELING AND SNOW DISCHARGING ASSEMBLY OF SNOW SWEEPING ROBOT

CROSS REFERENCE TO RELATED APPLICATION(S)

This patent application claims the benefit and priority of Chinese Patent Application No. 202110677370.9, filed on Jun. 18, 2021, the disclosure of which is incorporated by reference herein in its entirety as part of the present application.

TECHNICAL FIELD

The present disclosure relates to the field of snow sweeping machinery, and particularly relates to a snow shoveling and snow discharging assembly of a snow sweeping robot.

BACKGROUND ART

At present, the northern area of China frequently snows in winter and is extremely cold and severe in snow accumulation at −20° C. in daily life, when the snow is large, the road surface quickly has thick accumulated snow which can seriously affect the passing of people and vehicles, and if the snow is not cleaned in time, a hard and smooth ice layer can be formed under the continuous rolling action, traffic safety accidents are easily caused, and the accumulated snow on the road can cause people to easily slip and fall and cause a large number of traffic jam phenomena.

Therefore, snow removing devices such as snow sweeping device and snow shoveling devices are needed to remove the accumulated snow on the road surface in time. At the present stage, snow sweeping modes in China include manual snow sweeping and mechanical snow sweeping: the manual snow sweeping mode is time-consuming and labor-consuming, and can cause the risks of frostbite and falling injury; and mechanical snow sweeping equipment is heavy, and tail gas can pollute the environment.

An existing snow sweeping robot is generally used for firstly accumulating accumulated snow to a certain position on the road and then removing the accumulated snow out of the road through a snow sweeper, a snow sweeper in the prior art generally comprises a walking vehicle and a snow shoveling plate arranged in front of the walking vehicle, and the snow shoveling plate accumulates the accumulated snow to one side or accumulates the accumulated snow to the two sides parallel to a vehicle body. Therefore, snow shoveling needs to be completed by rotating the vehicle body by a certain angle, the working efficiency is low, and a large amount of time is consumed.

By adopting a snow sweeping mode of the snow sweeping robot, a large amount of labor force is saved, the snow clearing efficiency is improved, and various traffic hidden dangers are solved; however, due to the fact that the road surface is uneven, the accumulated snow on the road surface cannot be effectively removed due to the fact that the snow sweeping robot cannot sweep snow cleanly, and the applicability of the snow sweeping robot is greatly reduced.

SUMMARY

Aiming at the problems in the prior art, the present disclosure aims to solve the technical problems that the cleaning efficiency of accumulated snow is low and a large amount of time is consumed during snow shoveling.

In order to solve the technical problem, the present disclosure adopts the following technical scheme: a snow shoveling and snow discharging assembly of a snow sweeping robot comprises a snow stirring structure, a snow feeding structure and a snow raising structure.

The snow stirring structure comprises a stirring cage, a plurality of stirring cutters and a stirring cutter shaft, the stirring cage is of a semi-surrounding structure of which the front end and the lower end are open, the stirring cage is internally provided with the stirring cutter shaft, and a snow outlet is formed in the inner side of the stirring cage; the stirring cutter shaft is arranged in the stirring cage in the length direction of the stirring cage, and the two ends of the stirring cutter shaft are rotatably connected with the two ends of the stirring cage in the length direction respectively; the stirring cutters are installed on the stirring cutter shaft, and the centers of the stirring cutters are fixedly connected with the stirring cutter shaft; the extension lines of the projections of the stirring cutters on the horizontal plane are intersected at one point, and the intersection point is located at the projection of the snow outlet on the horizontal plane.

The snow feeding structure comprises a snow feeding pipe, a connecting pipe and an air blower; the snow feeding pipe is provided with a snow feeding pipe snow inlet and a snow feeding pipe snow outlet, the connecting pipe is vertically arranged on one side of the snow feeding pipe and is provided with a connecting pipe snow inlet and a connecting pipe snow outlet, and the connecting pipe snow inlet communicates with the snow feeding pipe snow outlet; and air port of the air blower faces the connecting pipe snow inlet and is used for forming air flow from the connecting pipe snow inlet to the connecting pipe snow outlet in the connecting pipe.

The snow raising structure comprises a snow raising pipe, a steering motor, a first turbine and a first worm; the first turbine is provided with a central hole; the snow raising pipe is of a long-strip-shaped structure, a snow raising opening is formed in the front end of the snow raising pipe, the bottom of the snow raising pipe communicates with the connecting pipe snow outlet through the central hole in the first turbine, the bottom of the snow raising pipe is fixed to the upper surface of the first turbine, the connecting pipe snow outlet is connected to the lower surface of the first turbine, and the connecting pipe snow outlet is rotatably connected with the lower surface of the first turbine; and an output shaft of the steering motor is fixedly connected with the first worm, and the first worm is meshed with the first turbine.

In the present disclosure, the stirring cutter shaft rotates to drive the stirring cutters to rotate, accumulated snow on the ground is smashed in the rotating process, the smashed accumulated snow is brought into the snow feeding pipe, and air flow from the connecting pipe snow inlet to the connecting pipe snow outlet is formed in the connecting pipe through the air blower, so that on one hand, snow entering the connecting pipe can be blown out from the connecting pipe snow outlet, on the other hand, certain siphon can be formed on snow in the snow feeding pipe, the snow in the snow feeding pipe is actively sucked to the connecting pipe, and then the snow is blown out from the connecting pipe snow outlet. The steering motor acts, the snow raising pipe is driven to rotate through a worm gear, and then the position of the accumulated snow is changed.

Preferably, the snow shoveling and snow discharging assembly also comprises a driving structure, and the driving structure comprises a motor, a driving box and a second turbine. The motor is arranged on the rear side outside the stirring cage, an output shaft of the motor penetrates through the driving box, the output shaft of the motor is rotatably connected with the driving box, and the axis of the output shaft of the motor is perpendicular to the axis of the stirring cutter shaft; the second turbine is arranged in the driving box and is fixedly connected with the output shaft of the motor; the stirring cutter shaft penetrates through the driving box and is rotatably connected with the driving box; and a worm thread is arranged on the stirring cutter shaft, is meshed with the second turbine, and is arranged in the driving box. When the motor acts, the output shaft of the motor penetrates through the driving box to drive the second turbine in the driving box to rotate, the second turbine is meshed with the worm thread on the stirring cutter shaft, the second turbine rotates to drive the stirring cutter shaft to rotate, and therefore automatic rotation of the stirring cutter shaft is achieved.

Preferably, the snow shoveling and snow discharging assembly also comprises a lifting structure, and the lifting structure comprises a connecting plate and a first electric push rod. One end of the connecting plate is fixedly connected with the outer side wall of the stirring cage, and the other end of the connecting plate is rotatably connected with a base of the snow sweeping robot; and the first electric push rod is vertically arranged, a connecting rod of the first electric push rod is rotatably connected with the part, close to the stirring cage, of the connecting plate, and a shell of the first electric push rod is fixedly connected with the base of the robot. The electric push rod and the connecting plate are additionally arranged on the stirring cage, so that the stirring cage can rotate by a certain angle around one end of the connecting plate, the stirring cage can be adjusted in the up-and-down direction, the removal of snow on the uneven road surface is greatly promoted, and the application range of the stirring cage is enlarged.

Preferably, the snow shoveling and snow discharging assembly also comprises an illuminating structure, and the illuminating structure comprises a fixed block and an illuminating lamp; the fixed block is arranged at the upper end of the stirring cage, the illuminating lamp is arranged on the fixed block, and the illuminating lamp is rotatably connected with the fixed block; and the lighting direction of the illuminating lamp faces the working area of the stirring cage. Therefore, light of the illuminating lamp can irradiate different positions, and the illumination range of the illuminating lamp is enlarged.

Preferably, the snow raising structure also comprises a guide structure; the guide structure comprises a guide part and a second electric push rod; the guide part is composed of two vertical side plates and a transverse plate fixed to the tops of the two side plates, and the transverse plate is rotatably connected with the top of the snow raising pipe; and a shell of the second electric push rod is fixed to the outer side wall of the snow raising pipe, and a rod piece of the second electric push rod is fixedly connected with the side plates of the guide part. The second electric push rod acts, so that the distance between the transverse plate and the top of the snow raising pipe is changed, and then the snow discharging direction is further changed.

Preferably, an arc through groove is formed in one side plate of the guide part, the circle center of the arc through groove is formed in the rotatable joint of the guide part and the snow raising pipe, a screw is arranged at the arc through groove, penetrates through the arc through groove and is perpendicularly and fixedly connected with the side face of the snow raising pipe, and the screw is in threaded connection with a fixed cap. The fixed cap is rotated to fix the rotation angle of the guide part, so that the guide part is prevented from loosening due to large impact force during snow blowing.

Preferably, the snow raising pipe is bent towards the other side connected with the transverse plate. In the snow discharging process, the accumulated snow can be discharged to the two sides of the snow sweeping robot more smoothly.

Preferably, an upper end opening of the snow raising pipe is larger than a lower end opening of the snow raising pipe. In order to enable the accumulated snow to be smoothly discharged from the interior of the snow raising pipe from bottom to top, the accumulated snow is prevented from being blocked in the snow raising pipe in the discharging process.

Compared with the prior art, the present disclosure at least has the following advantages:

firstly, the snow shoveling time is reduced, and the snow shoveling efficiency is improved; a snow discharging structure is additionally arranged on the rear side of a snow shoveling plate, so that an original mode that a vehicle body needs to rotate by a certain angle to accumulate snow is changed into a mode that the accumulated snow can be accumulated only by the vehicle body going straight, and the time consumed by rotating the vehicle body by a certain angle is saved;

secondly, the accumulation position of the accumulated snow can be adjusted freely; a worm gear driven by the motor is additionally arranged below the snow raising pipe, so that the snow raising pipe can rotate by a certain angle, and the left-right direction of snow raising is adjusted; a guide piece is additionally arranged at the upper end of the snow raising pipe, so that the up-and-down direction can be adjusted during snow raising;

thirdly, the removal of the accumulated snow on the road surface is cleaner; an electric push rod is additionally arranged on the stirring cage, so that the stirring cage can be adjusted in the up-and-down direction, the removal of snow on the uneven road surface is greatly promoted, and the application range of the stirring cage is enlarged; and fourthly, the accumulated snow on the road surface can be cleaned at night; an illuminating mechanism is additionally arranged at the front end of the stirring cage, and the illuminating lamp can rotate by a certain angle on the fixed block, so that light of the illuminating lamp can irradiate different positions during working at night, and the illumination range of the illuminating lamp is further enlarged.

REFERENCE SIGNS

10, base; 11, stirring cage; 12, stirring cutter; 13, stirring cutter shaft; 14, snow outlet; 21, snow feeding pipe; 22, connecting pipe; 31, snow raising pipe; 32, guide part; 32*a*, side plate; 32*b*, transverse plate; 33, second electric push rod; 34, steering motor; 35, first turbine; 36, first worm; 37, arc through groove; 38, fixed cap; 41, motor; 42, driving box; 43, second turbine; 51, connecting plate; 52, first electric push rod; 61, illuminating lamp; and 62, fixed block.

DETAILED DESCRIPTION OF THE EMBODIMENTS

The present disclosure is described in further detail below.

In the present disclosure, "front", "rear", "left", "right", "upper" and "lower" all indicate orientations in actual use, in which 'left' indicates outwards relative to paper, and 'right' indicates inwards relative paper. In the description of the present disclosure, it needs to be illustrated that, except as otherwise noted, the terms such as "install", "provided with", "sleeved/connected with" and "connect" should be generally understood, for example, the components can be fixedly connected, and also can be detachably connected or integrally connected; the components can be mechanically connected, and also can be electrically connected; the components can be directly connected, also can be indirectly connected through an intermediate, and can be communicated internally. For those skilled in the art, the specific meanings of the terms in the present disclosure can be understood according to specific conditions.

Figure 1:
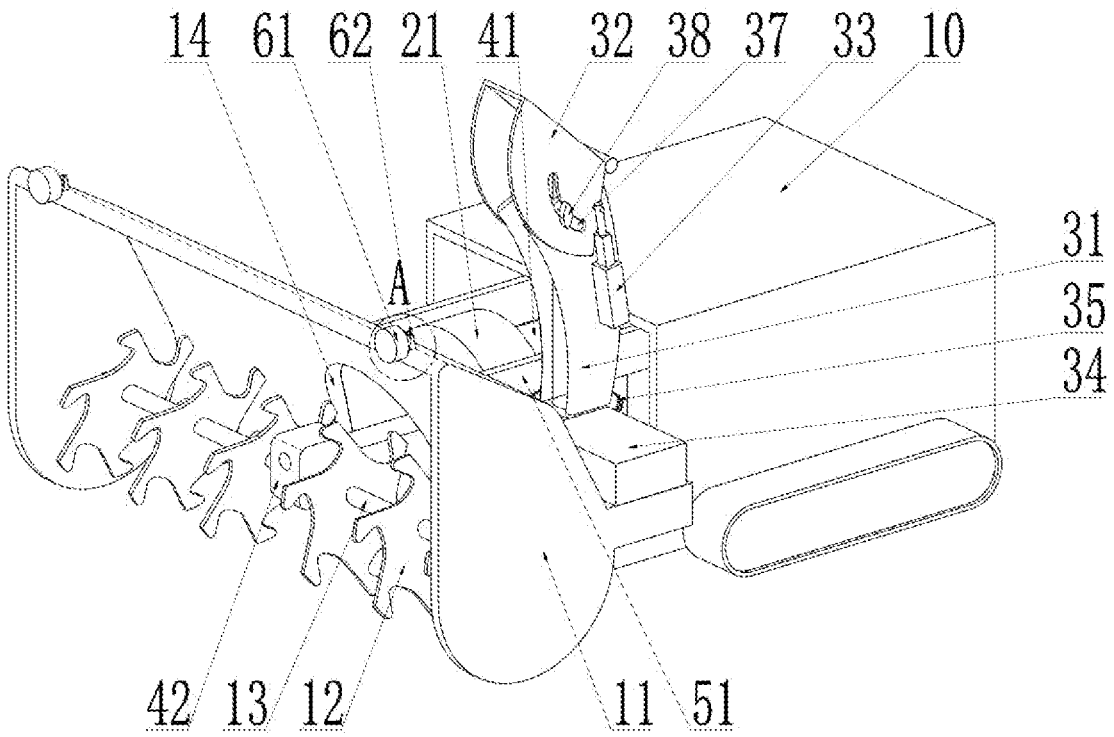
FIG. 1 is a space diagram of an integral device of the embodiment.
Figure 2:
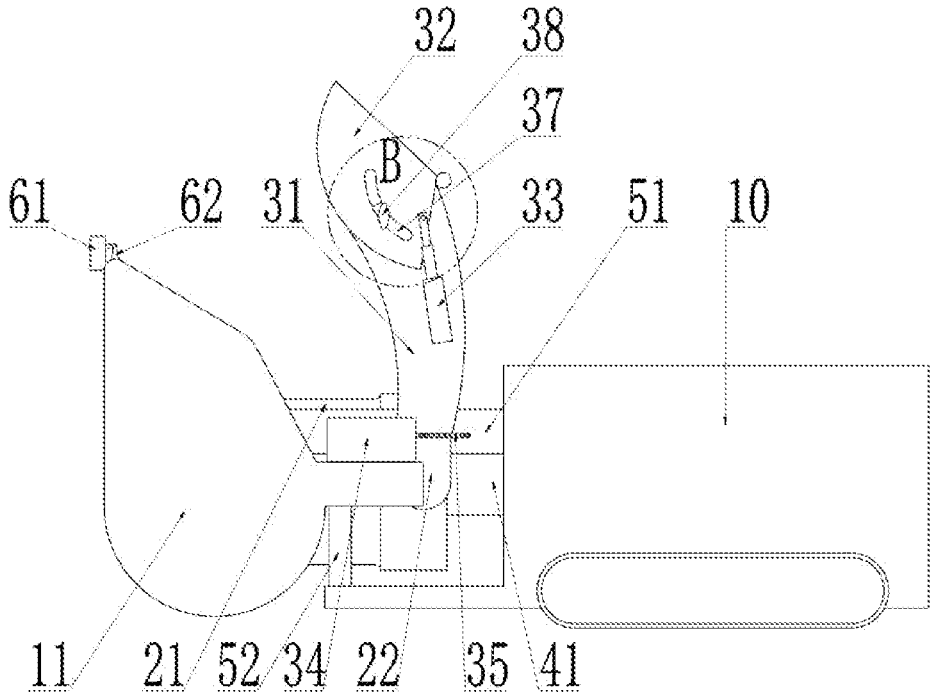
FIG. 2 is a right view of the integral device of the embodiment.
Figure 3:
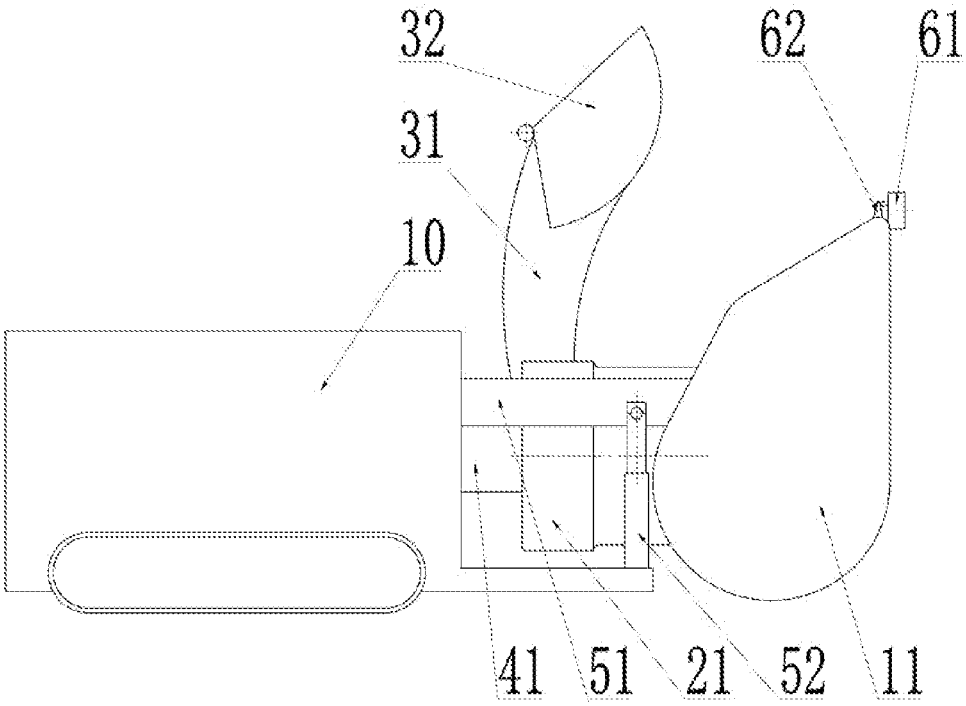
FIG. 3 is a left view of the integral device of the embodiment.
Figure 4:
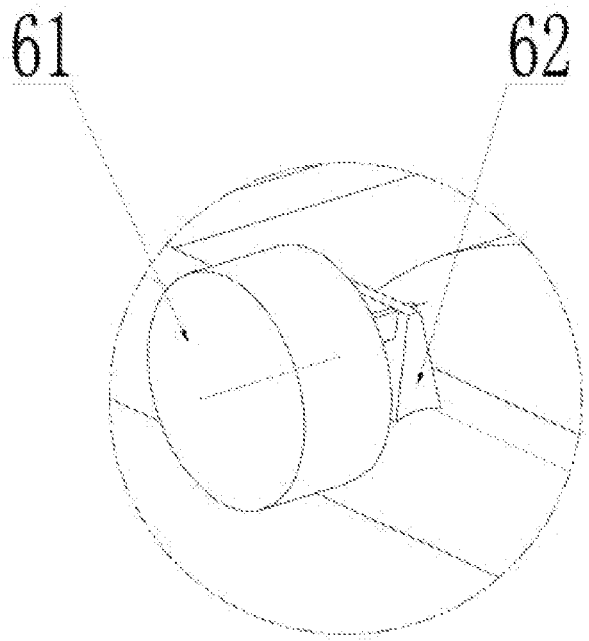
FIG. 4 is an enlarged view at the position of A in FIG. 1.
Figure 5:
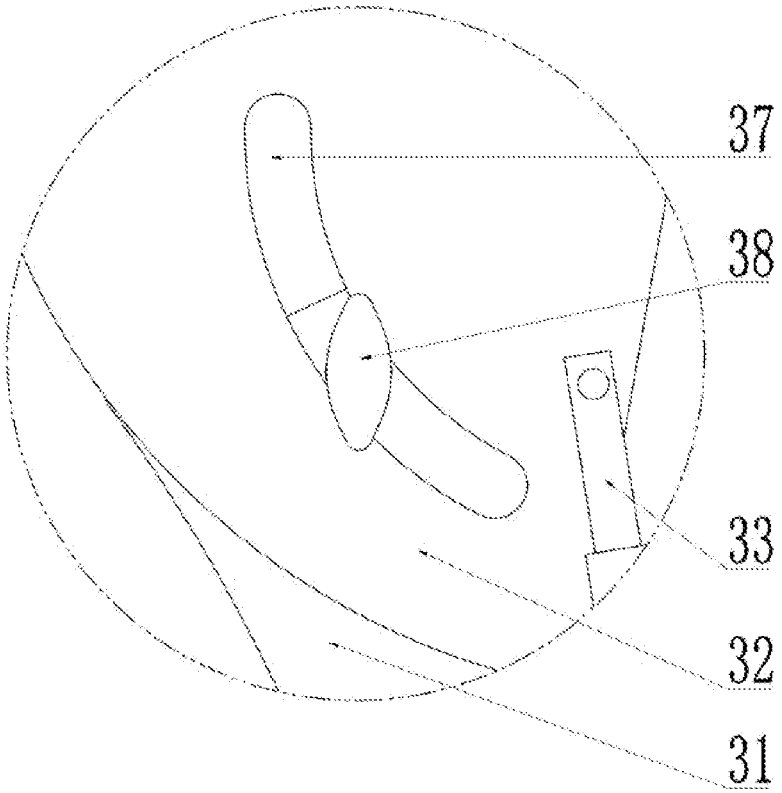
FIG. 5 is an enlarged view at the position of B in FIG. 2.
Figure 6:
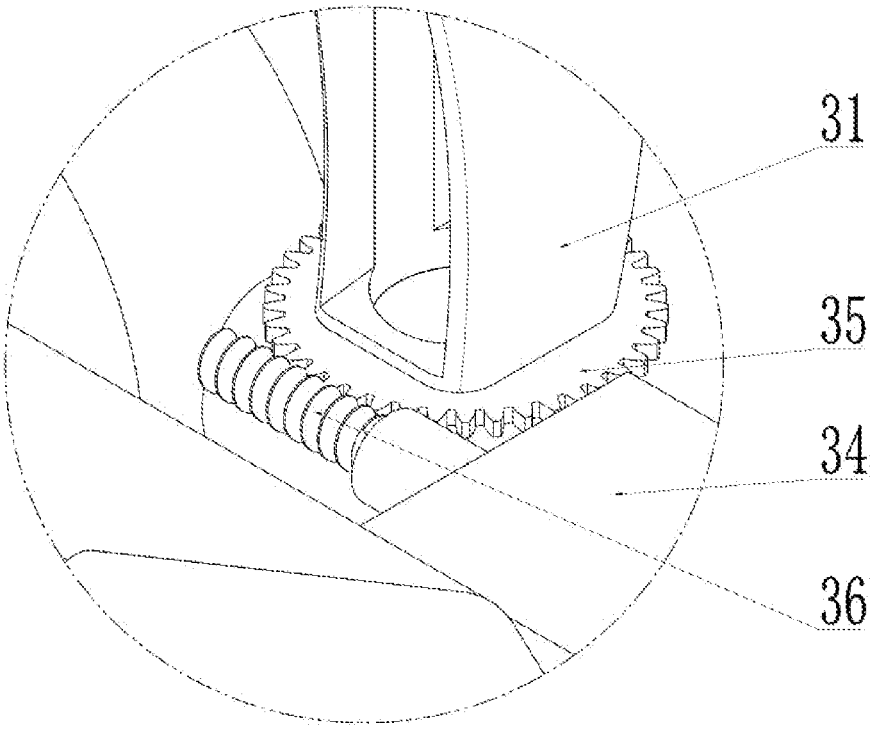
FIG. 6 is an enlarged view at the positions of a first turbine and a first worm.
Figure 7:
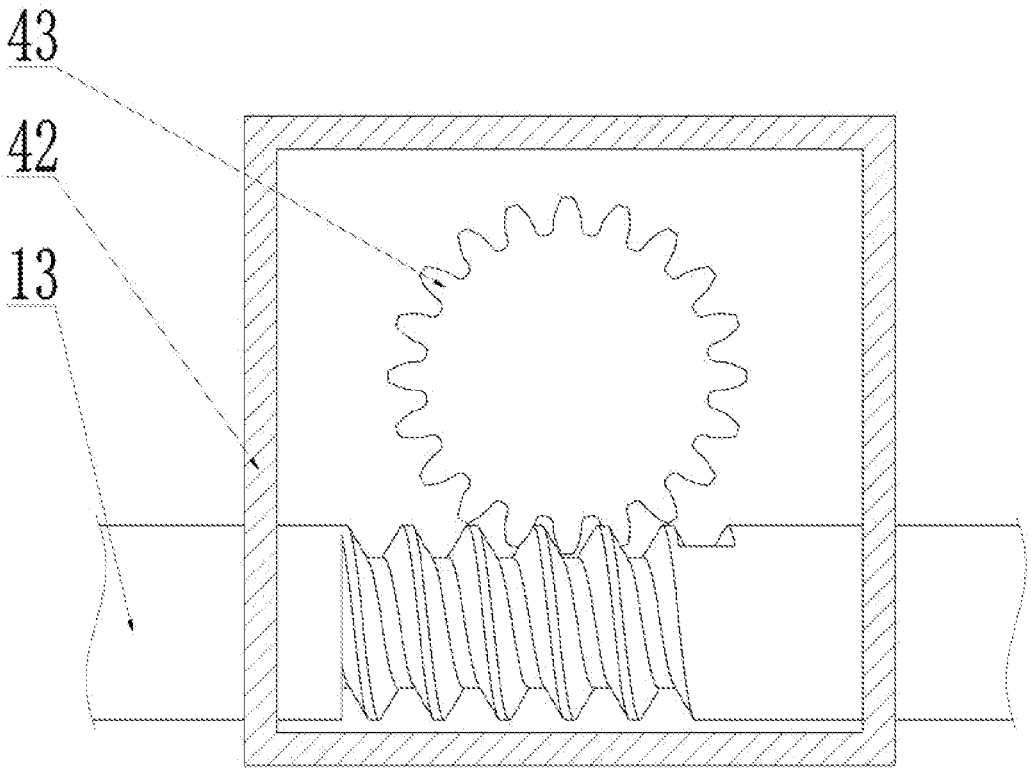
FIG. 7 is an internal structural schematic diagram of a driving box.
Figure 8:
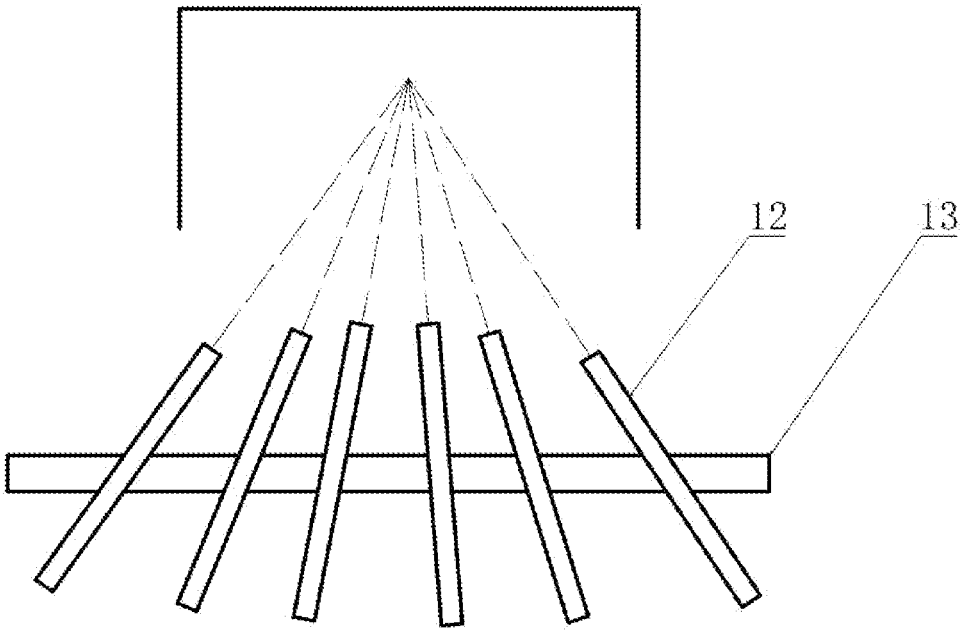
FIG. 8 is an arrangement orientation diagram of stirring cutters.
Figure 9:
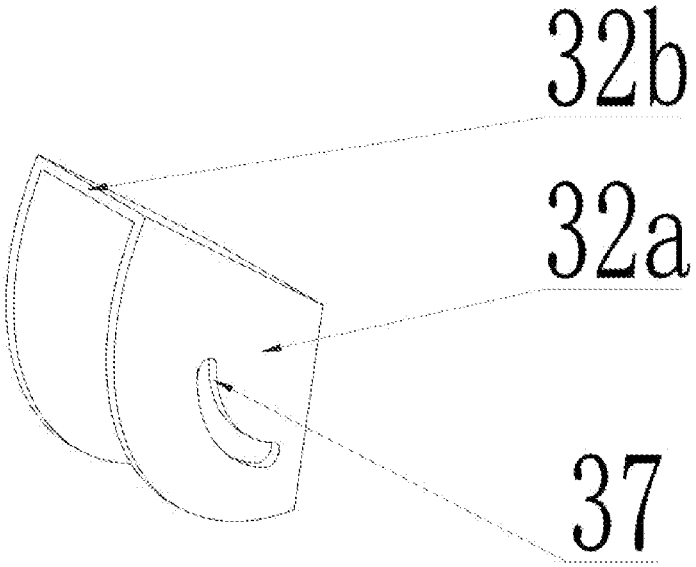
FIG. 9 is a structural diagram of a guide part.

Referring to FIG. 1 to FIG. 9, through an embodiment provided by the present disclosure, a snow shoveling and snow discharging assembly of a snow sweeping robot comprises a snow stirring structure, a snow feeding structure and a snow raising structure.

The snow stirring structure comprises a stirring cage 11, a plurality of stirring cutters 12 and a stirring cutter shaft 13, the stirring cage 11 is of a semi-surrounding structure of which the front end and the lower end are open, the stirring cage 11 is internally provided with the stirring cutter shaft 13, and a snow outlet 14 is formed in the inner side of the stirring cage 11; the stirring cutter shaft 13 is arranged in the stirring cage 11 in the length direction of the stirring cage 11, and the two ends of the stirring cutter shaft 13 are rotatably connected with the two ends of the stirring cage 11 in the length direction respectively; the stirring cutters 12 are installed on the stirring cutter shaft 13, and the centers of the stirring cutters 12 are fixedly connected with the stirring cutter shaft 13; the extension lines of the projections of the stirring cutters 12 on the horizontal plane are intersected at one point, and the intersection point is located at the projection of the snow outlet 14 on the horizontal plane; and during specific implementation, the lower end of the stirring cage 11 is higher than the lower ends of the stirring cutters 12, so that accumulated snow is conveniently crushed and removed by the stirring cutters 12, and the interference of the stirring cage 11 to the stirring cutters 12 is reduced. A plurality of crescent notches are formed in the surface of the stirring cutter 12 and are uniformly distributed in the circumferential direction of the stirring cutter 12. During specific implementation, a sharp corner is formed by the crescent notch and the stirring cutter 12, the accumulated snow on the ground is smashed in the rotating process of the sharp corner, and the smashed accumulated snow is brought into the snow outlet 14.

The snow feeding structure comprises a snow feeding pipe 21, a connecting pipe 22 and an air blower; the snow feeding pipe 21 is provided with a snow feeding pipe snow inlet and a snow feeding pipe snow outlet, the connecting pipe 22 is vertically arranged on one side of the snow feeding pipe 21 and is provided with a connecting pipe snow inlet and a connecting pipe snow outlet, and the connecting pipe snow inlet communicates with the snow feeding pipe snow outlet; and during specific implementation, the front end of the snow feeding pipe 21 can be opened to be the snow feeding pipe snow inlet, the rear end of the snow feeding pipe 21 is closed, the snow feeding pipe snow outlet is formed in the side face of the snow feeding pipe 21, and the snow feeding pipe snow inlet is fixedly connected with the snow outlet in the stirring cage 11 in a sealed mode, so that the accumulated snow in the stirring cage 11 can enter the snow feeding pipe 21. The snow feeding pipe 21 is arranged for storing snow temporarily on one hand, and for conveniently transferring the snow stirred by the stirring cage into the connecting pipe 22 on the other hand, and then the snow in the connecting pipe 22 is blown out by the air blower. An air port of the air blower faces the connecting pipe snow inlet and is used for forming air flow from the connecting pipe snow inlet to the connecting pipe snow outlet in the connecting pipe 22; and during specific implementation, the air blower can be fixedly arranged on one side of the snow feeding pipe 21, an air port of the air blower communicates with the snow feeding pipe 21, and the air blower is used for forming air flow from the connecting pipe snow inlet to the connecting pipe snow outlet in the connecting pipe 22, so that on one hand, snow entering the connecting pipe 22 can be blown out from the connecting pipe snow outlet, on the other hand, certain siphon can be formed on snow in the snow feeding pipe 21, the snow in the snow feeding pipe 21 is actively sucked to the connecting pipe 22, and then the snow is blown out from the connecting pipe snow outlet.

The snow raising structure comprises a snow raising pipe 31, a steering motor 34, a first turbine 35 and a first worm 36; the first turbine 35 is provided with a central hole; the snow raising pipe 31 is of a long-strip-shaped structure, a snow raising opening is formed in the front end of the snow raising pipe 31, the bottom of the snow raising pipe 31 communicates with the connecting pipe snow outlet through the central hole in the first turbine 35, the bottom of the snow raising pipe 31 is fixed to the upper surface of the first turbine 35, the connecting pipe snow outlet is connected to the lower surface of the first turbine 35, and the connecting pipe snow outlet is rotatably connected with the lower surface of the first turbine 35; and an output shaft of the steering motor 34 is fixedly connected with the first worm 36, and the first worm 36 is meshed with the first turbine 35.

Further, the snow shoveling and snow discharging assembly also comprises a driving structure, and the driving structure comprises a motor 41, a driving box 42 and a second turbine 43. The motor 41 is arranged on the rear side outside the stirring cage 1, an output shaft of the motor 41 penetrates through the driving box 42, the output shaft of the motor 41 is rotatably connected with the driving box 42, and the axis of the output shaft of the motor 41 is perpendicular to the axis of the stirring cutter shaft 13; during specific implementation, the driving box 42 is arranged in the middle of the stirring cutter shaft 13, and the number of the stirring cutters 12 at the two ends of the driving box 42 is equal, so that the stability of the two ends of the stirring cage 11 can be improved. The second turbine 43 is arranged in the driving box 42 and is fixedly connected with the output shaft of the motor 41; the stirring cutter shaft 13 penetrates through the driving box 42 and is rotatably connected with the driving box 42; and a worm thread is arranged on the stirring cutter shaft 13, is meshed with the second turbine 43, and is arranged in the driving box 42.

Further, the snow shoveling and snow discharging assembly also comprises a lifting structure, and the lifting structure comprises a connecting plate 51 and a first electric push rod 52. One end of the connecting plate 51 is fixedly connected with the outer side wall of the stirring cage 11, and the other end of the connecting plate 51 is rotatably connected with a base (10) of the snow sweeping robot; and during specific implementation, the connecting plate 51 rotates along the other end of the connecting plate 51, the number of the connecting plates 51 is generally two, the outer side walls of one end 21 of each of the two connecting plates 51 are fixedly connected, the joints of the two connecting plates 51 and the outer side wall of the stirring cage 11 are located at the ⅓ to ⅔ position of the length direction of the stirring cage 11, and therefore the stability of the stirring cage 11 in the working process can be kept as much as possible through connection. In addition, the number of the first electric push rods 52 is usually two, the two first electric push rods 52 are arranged on the outer sides of the corresponding connecting plates 51 respectively, and the two first electric push rods 52 are mainly considered to enable the two sides of the stirring cage 11 in the length direction to be stressed at the same time when the stirring cage 11 is lifted, so that the lifting speed can be guaranteed, and more importantly, stable lifting of the stirring cage 11 can be guaranteed as much as possible. The first electric push rod 52 is vertically arranged, a connecting rod of the first electric push rod 52 is rotatably connected with the part, close to the stirring cage 11, of the connecting plate 51, and a shell of the first electric push rod 52 is fixedly connected with the base 10 of the robot. During specific implementation, the number of the first electric push rods 52 is two, the first electric push rods 52 are arranged on the two sides of the motor 41 respectively, and the two first electric push rods 52 move up and down at the same time, so that the pressure of the first electric push rods 52 can be reduced, and the lifting stability of the stirring cage 11 is also improved.

Further, the snow shoveling and snow discharging assembly also comprises an illuminating structure, and the illuminating structure comprises a fixed block 62 and an illuminating lamp 62; the fixed block 62 is arranged at the upper end of the stirring cage 11, the illuminating lamp 61 is arranged on the fixed block 62, and the illuminating lamp 61 is rotatably connected with the fixed block 62; and the lighting direction of the illuminating lamp 61 faces the working area of the stirring cage 11. During specific implementation, two bosses are fixedly arranged at the front and rear positions of the upper end of the fixed block 62 respectively, and the front and rear ends of the illuminating lamp 61 are rotatably connected with the two bosses through bolts respectively, so that light of the illuminating lamp 61 can irradiate different positions, and the illumination range of the illuminating lamp 61 is enlarged.

Further, the snow raising structure also comprises a guide structure; the guide structure comprises a guide part 32 and a second electric push rod 33; the guide part 32 is composed of two vertical side plates 32*a* and a transverse plate 32*b* fixed to the tops of the two side plates 32*a*, and the transverse plate 32*b* is rotatably connected with the top of the snow raising pipe 31; and a shell of the second electric push rod 33 is fixed to the outer side wall of the snow raising pipe 31, and a rod piece of the second electric push rod 33 is fixedly connected with the side plates 32*a* of the guide part 32. During specific implementation, the transverse plate 32*b* can be of a rectangular structure, the two vertical side plates 32*a* can be of fan-shaped structure, one edge of each of the two fans is fixedly connected with one long edge of the transverse plate 32*b*, one short edge of the transverse plate 32*b* is rotatably connected with the corresponding edge of the top of the snow raising pipe 31 through a hinge, and the side plates 32*a* are driven to rotate with the hinge as the axis through stretching and retracting of the second electric push rod 33. Therefore, the distance between the transverse plate 32*b* and the top of the snow raising pipe 31 is changed, and then the snow discharging direction is further changed.

Further, an arc through groove 37 is formed in one side plate 32*a* of the guide part 32, the circle center of the arc through groove 37 is formed in the rotatable joint of the guide part 32 and the snow raising pipe 31, a screw is arranged at the arc through groove 37, penetrates through the arc through groove 37 and is perpendicularly and fixedly connected with the side face of the snow raising pipe 31, and the screw is in threaded connection with a fixed cap 38. During specific implementation, the fixed cap 38 is rotated to fix the rotation angle of the guide part 32, so that the guide part 32 is prevented from loosening due to large impact force during snow blowing. The included angle between the transverse plate 32 and the rear side wall of the snow raising pipe 31 is larger than 90? and smaller than 180?, so that the situation that an outlet of the snow raising pipe 31 is blocked due to the fact that the included angle is too small in the discharging process of the accumulated snow, when the included angle is too large, the accumulated snow in the snow raising pipe 31 is directly discharged, and the guide part 32 cannot achieve a guiding effect is avoided.

Further, the snow raising pipe 31 is bent towards the other side connected with the transverse plate 32*b*. During specific implementation, in the snow discharging process, the accumulated snow can be discharged to the two sides of the snow sweeping robot more smoothly.

Further, an upper end opening of the snow raising pipe 31 is larger than a lower end opening of the snow raising pipe 31. In order to enable the accumulated snow to be smoothly discharged from the interior of the snow raising pipe 31 from bottom to top, the accumulated snow is prevented from being blocked in the snow raising pipe 31 in the discharging process.

The working principle of the snow shoveling and snow discharging assembly of a snow sweeping robot is as follows:

The motor 41 works, the output shaft of the motor 41 rotates, the output shaft of the motor 41 drives the second turbine 43 fixedly connected with the output shaft to rotate, the second turbine 43 drives the stirring cutter shaft 13 partially meshed with the second turbine 43 to rotate, and the stirring cutter shaft 13 drives a plurality of stirring cutters 12 fixed on the stirring cutter shaft 13 to rotate. Due to the fact that the stirring cutters all slantly faces the snow outlet 14 in the inner side of the stirring cage 11 when all of the stirring cutters 12 are arranged, the accumulated snow on the ground can be stirred up in the rotating process of the stirring cutters 12 and is stirred away towards the snow outlet 14 in the inner side of the stirring cage 11, and therefore the accumulated snow on the road surface is stirred into the snow feeding pipe 21.

When the road surface is uneven, the first electric push rod 52 starts to act, when the connecting rod of the first electric push rod 52 is extended, the connecting rod of the first electric push rod 52 drives the end, connected with the connecting rod, of the connecting plate 51 to rotate upwards, and the other end of the connecting plate 51 rotates upwards at the joint with the base 10; when the connecting rod of the first electric push rod 52 is shortened, the connecting rod of the first electric push rod 52 drives the end, connected with the connecting rod, of the connecting plate 51 to rotate downwards, the other end of the connecting plate 51 rotates downwards at the joint with the base 10, and therefore up-and-down pitching movement of the stirring cage 11 is achieved through stretching and retracting of the connecting rod of the first electric push rod 52. A certain distance can be completely kept between the stirring cutters 12 in the stirring cage 11 and the ground, so that the accumulated snow on the road surface can be swept more thoroughly.

The air blower starts to act and forms air flow from the connecting pipe snow inlet to the connecting pipe snow outlet in the connecting pipe 22, so that on one hand, snow entering the connecting pipe 22 can be blown out from the connecting pipe snow outlet, on the other hand, certain siphon can be formed on the snow in the snow feeding pipe 21, the snow in the snow feeding pipe 21 is actively sucked into the connecting pipe 22, and then the accumulated snow is blown out from the connecting pipe snow outlet; and the accumulated snow thus arrives in the snow raising pipe 31 and is then discharged from the snow raising pipe 31.

The steering motor 34 acts, and the output shaft of the steering motor 34 drives the snow raising pipe 31 to rotate by a certain angle in the vertical direction through a worm gear, so that the snow raising direction is controlled. When the second electric push rod 33 is extended, the connecting rod of the second electric push rod 33 pushes the guide part 32 to rotate upwards, when the second electric push rod 33 is shortened, the connecting rod of the second electric push rod 33 pushes the guide part 32 to rotate downwards, through stretching and retracting of the second electric push rod 33, pitching of the guide part 32 is controlled, and control over the height of snow during snow raising is achieved.

In order to ensure the stability of the guide part 32 in the snow raising process, the fixed cap 38 is screwed down, pressure is applied to the guide part 32 through the fixed cap 38 and the side wall of the snow raising pipe 31, so that the guide part 32 is clamped, and when the angle of the guide part 32 needs to be adjusted, the angle of the guide part 32 can be adjusted by unscrewing the fixed cap 38.

During working at night, in order to provide a good working environment, the illuminating lamp 61 can rotate by a certain angle along the fixed block 62, so that light of the illuminating lamp 61 can irradiate a specific working position more accurately, and the illumination efficiency of the illuminating lamp 61 is improved.

Finally, it is noted that the above-mentioned embodiments are only used for illustrating the technical scheme of the present disclosure but not restricting the scope of protection of the present disclosure; and although the present disclosure is described in detail by reference to a better embodiment, those ordinary skilled in the art should understand that the technical scheme of the present disclosure can be amended or equally substituted but not departing from the purpose and scope of the technical scheme of the present disclosure and should be contained in the scope of claims of the present disclosure.

What is claimed is:

1. A snow shoveling and snow discharging assembly of a snow sweeping robot, comprising a snow stirring structure, a snow feeding structure and a snow raising structure, wherein the snow stirring structure comprises a stirring cage, a plurality of stirring cutters and a stirring cutter shaft, the stirring cage is of a semi-surrounding structure of which the front end and the lower end are open, the stirring cage is internally provided with the stirring cutter shaft, and a snow outlet is formed in the inner side of the stirring cage;

the stirring cutter shaft is arranged in the stirring cage in the length direction of the stirring cage, and the two ends of the stirring cutter shaft are rotatably connected with the two ends of the stirring cage in the length direction respectively;

the stirring cutters are installed on the stirring cutter shaft, and the centers of the stirring cutters are fixedly connected with the stirring cutter shaft; extension lines of the projections of the stirring cutters on the horizontal plane are intersected at one point, and the intersection point is located at the projection of the snow outlet on the horizontal plane;

the snow feeding structure comprises a snow feeding pipe, a connecting pipe and an air blower;

the snow feeding pipe is provided with a snow feeding pipe snow inlet and a snow feeding pipe snow outlet, the connecting pipe is vertically arranged on one side of the snow feeding pipe and is provided with a connecting pipe snow inlet and a connecting pipe snow outlet, and the connecting pipe snow inlet communicates with the snow feeding pipe snow outlet;

an air port of the air blower faces the connecting pipe snow inlet and is used for forming air flow from the connecting pipe snow inlet to the connecting pipe snow outlet in the connecting pipe;

the snow raising structure comprises a snow raising pipe, a steering motor, a first turbine and a first worm;

the first turbine is provided with a central hole;

the snow raising pipe is of a long-strip-shaped structure, a snow raising opening is formed in the front end of the snow raising pipe, the bottom of the snow raising pipe communicates with the connecting pipe snow outlet through the central hole in the first turbine, the bottom of the snow raising pipe is fixed to the upper surface of the first turbine, the connecting pipe snow outlet is connected to the lower surface of the first turbine, and the connecting pipe snow outlet is rotatably connected with the lower surface of the first turbine;

an output shaft of the steering motor is fixedly connected with the first worm, and the first worm is meshed with the first turbine;

further comprising a driving structure, wherein the driving structure comprises a motor, a driving box and a second turbine;

the motor for driving the second turbine is arranged on the rear side outside the stirring cage, an output shaft of the motor penetrates through the driving box, the output shaft of the motor is rotatably connected with the driving box, and the axis of the output shaft of the motor is perpendicular to the axis of the stirring cutter shaft;

the driving box is configured to house the second turbine and a worm thread of the stirring cutter shaft;

the second turbine is fixedly connected with the output shaft of the motor;

the stirring cutter shaft penetrates through the driving box and is rotatably connected with the driving box; and a worm thread is arranged on the stirring cutter shaft, is meshed with the second turbine.

2. The snow shoveling and snow discharging assembly of a snow sweeping robot according to claim 1, further comprising a lifting structure, wherein the lifting structure comprises a connecting plate and a first electric push rod;

one end of the connecting plate is fixedly connected with the outer side wall of the stirring cage, and another end of the connecting plate is rotatably connected with a base of the snow sweeping robot; and the first electric push rod is vertically arranged, a connecting rod of the first electric push rod is rotatably connected with the part, close to the stirring cage, of the connecting plate, and a shell of the first electric push rod is fixedly connected with the base of the robot.

3. The snow shoveling and snow discharging assembly of a snow sweeping robot according to claim 2, wherein an arc through groove is formed in one side plate of the guide part, the circle center of the arc through groove is formed in the rotatable joint of the guide part and the snow raising pipe, a screw is arranged at the arc through groove, penetrates through the arc through groove and is perpendicularly and fixedly connected with the side face of the snow raising pipe, and the screw is in threaded connection with a fixed cap.

4. The snow shoveling and snow discharging assembly of a snow sweeping robot according to claim 1, further comprising an illuminating structure, wherein the illuminating structure comprises a fixed block and an illuminating lamp;

the fixed block is arranged at the upper end of the stirring cage, the illuminating lamp is arranged on the fixed block, and the illuminating lamp is rotatably connected with the fixed block; and the lighting direction of the illuminating lamp faces the working area of the stirring cage.

5. The snow shoveling and snow discharging assembly of a snow sweeping robot according to claim 4, wherein an arc through groove is formed in one side plate of a guide part, the circle center of the arc through groove is formed in the rotatable joint of the guide part and the snow raising pipe, a screw is arranged at the arc through groove, penetrates through the arc through groove and is perpendicularly and fixedly connected with the side face of the snow raising pipe, and the screw is in threaded connection with a fixed cap.

6. The snow shoveling and snow discharging assembly of a snow sweeping robot according to claim 1, wherein the snow raising structure also comprises a guide structure; the guide structure comprises a guide part and a second electric push rod;

the guide part is composed of two vertical side plates and a transverse plate fixed to the tops of the two side plates, and the transverse plate is rotatably connected with the top of the snow raising pipe; and a shell of the second electric push rod is fixed to the outer side wall of the snow raising pipe, and a rod piece of the second electric push rod is fixedly connected with the side plates of the guide part.

7. The snow shoveling and snow discharging assembly of a snow sweeping robot according to claim 6, wherein an arc through groove is formed in one side plate of the guide part, the circle center of the arc through groove is formed in the rotatable joint of the guide part and the snow raising pipe, a screw is arranged at the arc through groove, penetrates through the arc through groove and is perpendicularly and fixedly connected with the side face of the snow raising pipe, and the screw is in threaded connection with a fixed cap.

8. The snow shoveling and snow discharging assembly of a snow sweeping robot according to claim 6, wherein an arc through groove is formed in one side plate of the guide part, the circle center of the arc through groove is formed in the rotatable joint of the guide part and the snow raising pipe, a screw is arranged at the arc through groove, penetrates through the arc through groove and is perpendicularly and fixedly connected with the side face of the snow raising pipe, and the screw is in threaded connection with a fixed cap.

9. The snow shoveling and snow discharging assembly of a snow sweeping robot according to claim 1, wherein the snow raising pipe is bent towards another side connected with the transverse plate.

10. The snow shoveling and snow discharging assembly of a snow sweeping robot according to claim 1, wherein an upper end opening of the snow raising pipe is larger than a lower end opening of the snow raising pipe.

11. The snow shoveling and snow discharging assembly of a snow sweeping robot according to claim 1, wherein an arc through groove is formed in one side plate of the guide part, the circle center of the arc through groove is formed in the rotatable joint of the guide part and the snow raising pipe, a screw is arranged at the arc through groove, penetrates through the arc through groove and is perpendicularly and fixedly connected with the side face of the snow raising pipe, and the screw is in threaded connection with a fixed cap.

* * * * *